US009553400B1

(12) United States Patent
Benham et al.

(10) Patent No.: US 9,553,400 B1
(45) Date of Patent: Jan. 24, 2017

(54) VIBRATION RESISTANT CONNECTOR

(71) Applicant: Winchester Electronics Corporation, Middlebury, CT (US)

(72) Inventors: John E. Benham, Torrington, CT (US); David J. Camelio, Foxboro, MA (US)

(73) Assignee: Winchester Electronics Corporation, Middlebury, CT (US)

( * ) Notice: Subject to any disclaimer, the term of this patent is extended or adjusted under 35 U.S.C. 154(b) by 0 days.

(21) Appl. No.: 14/851,915

(22) Filed: Sep. 11, 2015

(51) Int. Cl.

| | |
|---|---|
| ***H01R 13/64*** | (2006.01) |
| ***H01R 13/533*** | (2006.01) |
| ***H01R 4/18*** | (2006.01) |
| ***H01R 13/52*** | (2006.01) |

(52) U.S. Cl.
CPC ..... *H01R 13/533* (2013.01); *H01R 4/18* (2013.01); *H01R 13/5205* (2013.01)

(58) Field of Classification Search
CPC ..... H01R 13/6315; H01R 33/00
USPC .... 439/248, 247, 559, 560, 277, 588, 92, 94
See application file for complete search history.

(56) References Cited

U.S. PATENT DOCUMENTS 8,047,872 B2 * 11/2011 Burris ..... H01R 13/502 439/271

* cited by examiner

*Primary Examiner* — Phuongchi T Nguyen
(74) *Attorney, Agent, or Firm* — Rothwell, Figg, Ernst & Manbeck, P.C.

(57) ABSTRACT

A vibration resistant connector is disclosed. The connector employs a friction member to create a resistance between a coupling nut of the connector and a connector body of the connector that is disposed in a cavity formed by the coupling nut. In some embodiments, the friction member is in the form of an O-ring that encircles a portion of the connector body and that is compressed by the coupling nut.

5 Claims, 2 Drawing Sheets

VIBRATION RESISTANT CONNECTOR

TECHNICAL FIELD

This disclosure is related to the field of vibration resistant connectors.

BACKGROUND

In a vibratory environment, such as an aircraft, train, truck or other moving vehicle, a lock wire is commonly used to secure a coupling nut of a connector and, thereby, keep the connector in a mated state. Lock wires are placed through small holes drilled into the coupling nut of the connector then secured to a structure (e.g., an airframe). Attaching lock wires to the coupling nut and then to the airframe is difficult, time consuming, and contributes scrap material that may migrate into critical areas of the vehicle. Accordingly, the use of lock wires should be avoided whenever possible.

SUMMARY

This disclosure provides a vibration resistant connector that can be used in vibratory environments without the need of lock wires for keeping the connector in a connected state during use.

The above and other aspects and embodiments are described below.

DETAILED DESCRIPTION

Figure 1:
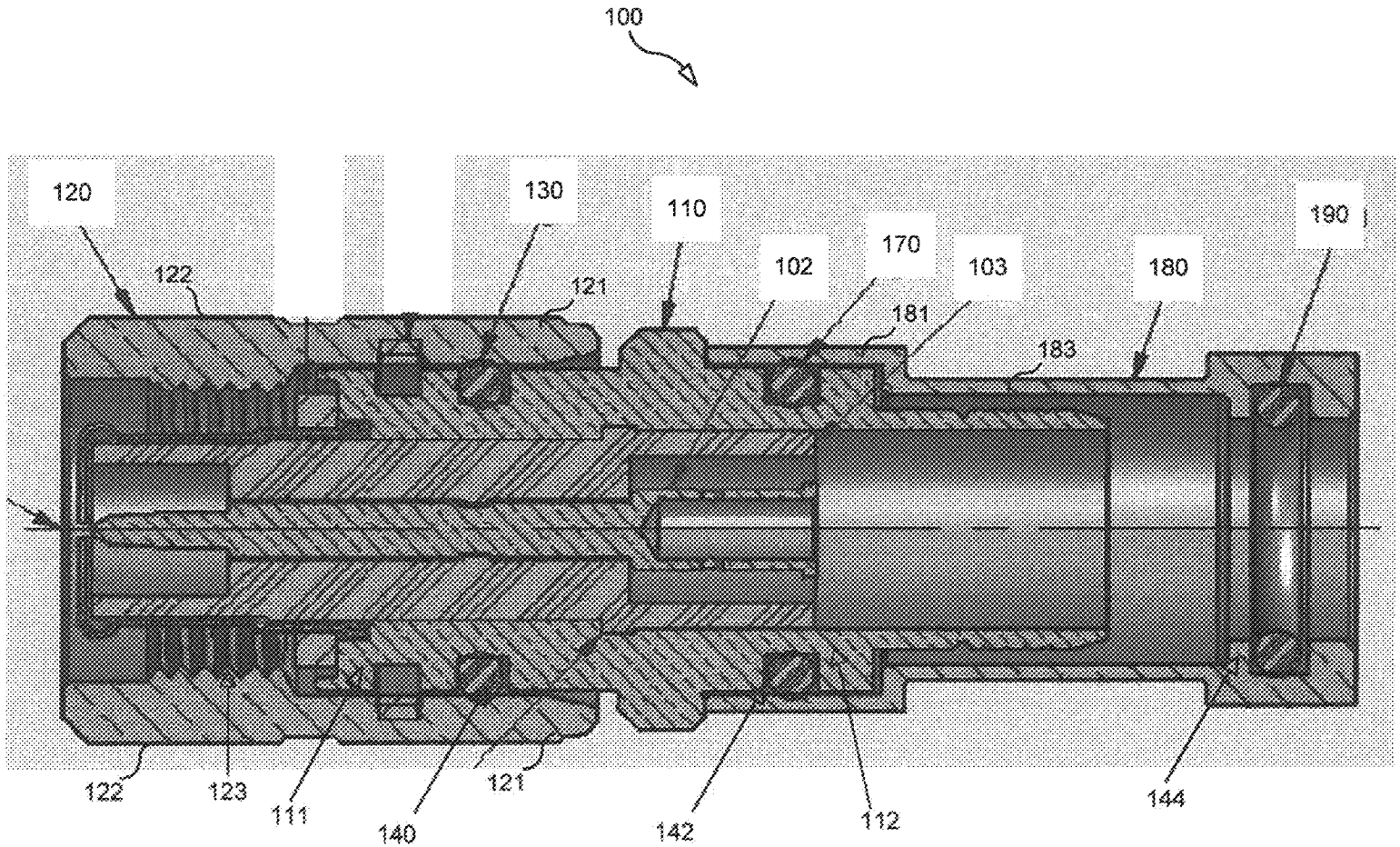
FIG. 1 is a cross-sectional view of a vibration resistant connector according to some embodiments.

FIG. 1 is a view of a vibration resistant connector 100 according to some embodiments. In the embodiment shown, connector 100 includes a connector body 110 defining a cavity for housing a contact 102 (e.g., a male or female electrical conductor, an optical fiber, etc.). As shown, the contact 102 may be disposed within an insulator 103 that is housed by the connector body 110. As further shown, connector 100 includes a coupling nut 120 for securing the connector 100 to a corresponding mating connector.

Coupling nut 120 has a first end portion 121 having a hollow cylindrical configuration. The first end portion 121 of coupling nut 120 is disposed around a first end portion 111 of connector body 110 to permit rotation of the coupling nut 120 relative to the connector body 110. That is, the first end portion 111 is disposed in a cavity formed by the end portion 121 of coupling nut 120. Coupling nut 120 has a second end portion 122 also having a hollow cylindrical configuration and further having a threaded inner wall 123 to permit the coupling nut 120 to be securely coupled with an externally threaded mating connector via rotation of the coupling nut. The coupling nut thread 123 can be standard 60 degree thread geometry. In high reliability applications, Stanley's SPIRALOCK® can be used.

Advantageously, a friction member 130 is disposed between the first end portion 121 of coupling nut 120 and the first end portion 111 of connector body 110. In some embodiments, the friction member 130 is resilient and is held in compression between the first end portion 121 of coupling nut 120 and the first end portion 111 of connector body 110.

The friction member 130 has a coefficient of friction effective to reduce the possibility of the coupling nut 120 rotating in a loosening direction due to vibration when the coupling nut is coupled with an externally threaded mating connector while permitting the coupling nut 120 to be rotated by hand. In some embodiments, the friction member exerts prevailing torque creating resistance between the connector body 110 and the coupling nut 120, thereby inhibiting rotation of the coupling nut 120 due to vibrations. The friction member may create a continuous prevailing torque between 0.5 and 1 in-lbs.

In some embodiments, the friction member 130 includes or consists of a ring-shaped member (e.g., an O-ring). The O-ring may be a rubber O-ring. In such embodiments, an annular groove 140 may be formed in at least one of an outer surface of the first end 11 of the connector body 110 and an inner surface of the first end 121 of the coupling nut 120, and the ring-shaped resilient friction member 130 is disposed within the annular groove. In some embodiments, the resilient friction member 130 is configured to apply a frictional force creating a prevailing torque between about 0.5 and 1.0 inch-lbs.

To address ingress of moisture into the connector 100, in some embodiments, connector 100 further includes a ferrule 180 having a hollow cylindrical configuration and having a first end portion 181, which is disposed around a second end portion 112 of the connector body 110, and a second end portion 182. Ferrule 180 may have a hex crimp zone 183 between end portions 181 and 182. An O-ring 170 is disposed in an annular groove 142 formed in an outer surface of the second end portion 112 of connector body 110. The first end portion 181 of the ferrule 180 covers and compresses the O-ring. Another O-ring 190 is disposed in an annular groove formed in an inner surface of end portion 182. The crimp zone 183 of ferrule being crimpable between the O-rings 170 and 190 to cause the O-rings 170 and 190 to create a seal between a jacket of a cable (not shown) inserted into the ferrule and connector body.

Figure 2:
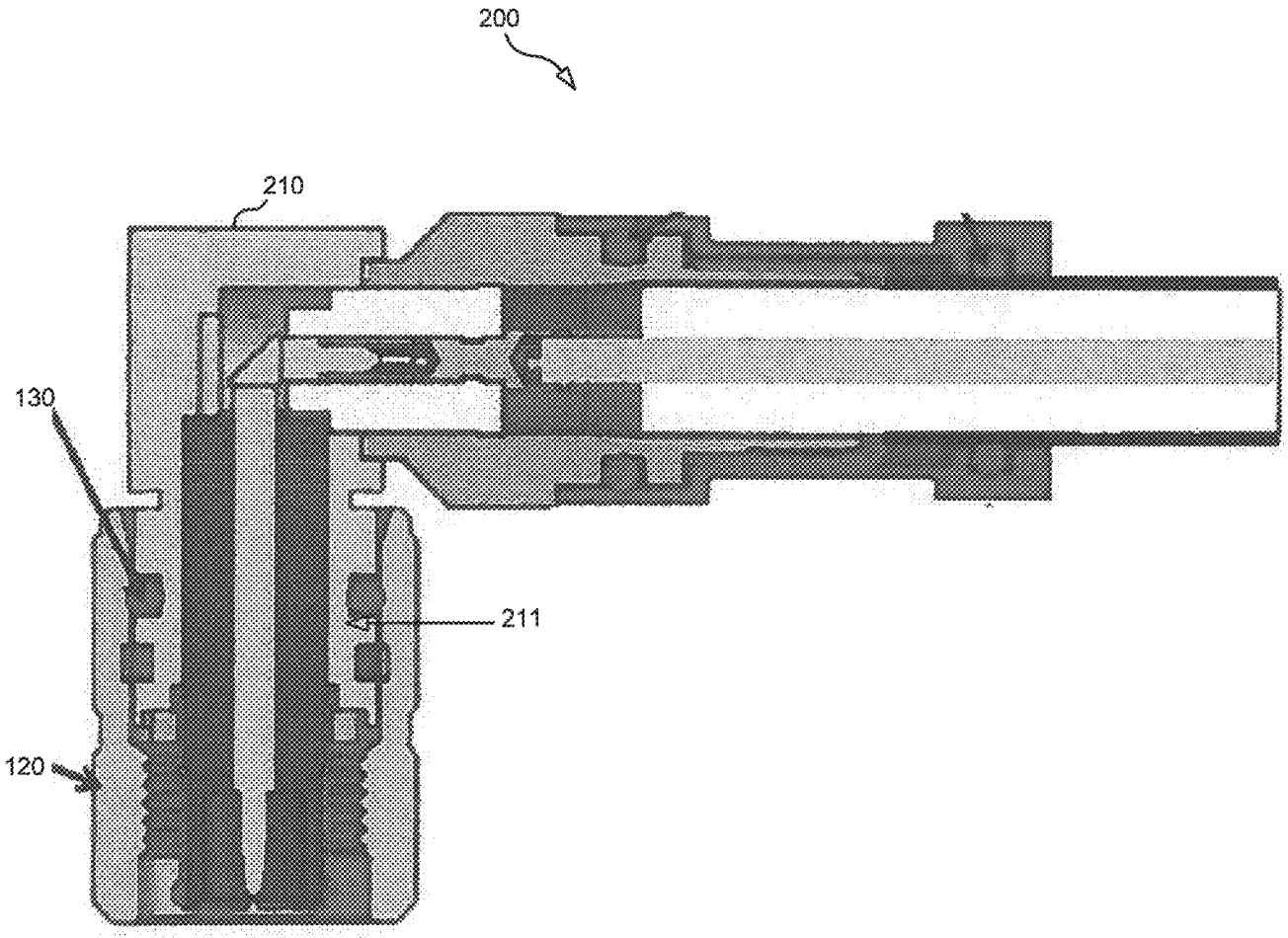
FIG. 2 is a cross-sectional view of a vibration resistant connector according to another embodiment.

FIG. 2 illustrates a right angle connector 200 according another embodiment. Connector 200 is similar to connector 100 in that connector 200 includes coupling nut 120, a connector housing 210 having a first end portion 211 disposed in the cavity formed by end portion 121 of coupling nut 120, and friction member 130 between end portion 121 of coupling nut 120 and end portion 211 of connector body 210. As with the embodiment shown in FIG. 1, friction member may be in the form of an O-ring and disposed in an annular groove formed in an outer surface of end portion 211 of connector body 210 such that the O-ring is compressed radially by the coupling nut 120.

While various embodiments have been described above, it should be understood that they have been presented by way of example only, and not limitation. Thus, the breadth and scope of the present disclosure should not be limited by any of the above-described exemplary embodiments. Moreover, any combination of the above-described elements in all possible variations thereof is encompassed by the disclosure unless otherwise indicated herein or otherwise clearly contradicted by context.

The invention claimed is:

1. A connector comprising:

a connector body defining a cavity for housing a contact;

a coupling nut comprising a first end portion of hollow cylindrical configuration defining a cavity in which a first end portion of said connector body is disposed, wherein the coupling nut is able to rotate relative to said connector body, said coupling nut further including a second end portion of hollow cylindrical configuration with a threaded inner wall to permit the connector to be coupled with an externally threaded mating connector via rotation of the coupling nut; and a friction member disposed in said cavity between said first end portion of said connector body and said first end portion of said coupling nut, said friction member having a coefficient of friction effective to reduce the possibility of said coupling nut rotating in a loosening direction due to vibration when said electrical connector is coupled with an externally threaded mating connector while permitting said coupling nut to be turned by hand, wherein the connector is configured such that, prior to the connector being coupled with an externally threaded mating connector via rotation of the coupling nut, the coupling nut imparts an inward, radial force on said friction member causing compression of said friction member, wherein the friction member, as a result of the radial force on said friction member, exerts a prevailing torque creating resistance between the connector body and the coupling nut preventing free-spinning of the of the coupling nut relative to the connector body.

2. The connector of claim 1, further comprising:

a ferrule of hollow cylindrical configuration having a first end, which is disposed around a second end of said connector body, and a second end configured to receive a cable;

a first O-ring disposed between said first end of said ferrule and said second end of said connector body; and a second O-ring, wherein said ferrule is crimpable between said first and second O-rings for causing said first and second O-rings to create a seal between a jacket of a cable and said connector body.

3. The connector of claim 1, wherein said friction member consists of a resilient O-ring.

4. The connector of claim 2, wherein an annular groove is formed in at least one of an outer surface of said first end portion of said connector body and an inner surface of said first end portion of said coupling nut, and wherein said O-ring is disposed within said annular groove.

5. The connector of claim 4, wherein the prevailing torque is between about 0.5 and 1.0 inch-lbs.

* * * * *